US006851893B1

(12) United States Patent
Bridgeman

(10) Patent No.: US 6,851,893 B1
(45) Date of Patent: Feb. 8, 2005

(54) PORTABLE MOORING DOCK FOR A BOAT

(76) Inventor: Jamie R. Bridgeman, 2151 Erie Ct., Tracy, CA (US) 95304

( * ) Notice: Subject to any disclaimer, the term of this patent is extended or adjusted under 35 U.S.C. 154(b) by 0 days.

(21) Appl. No.: 10/777,690

(22) Filed: Feb. 13, 2004

(51) Int. Cl.[7] ..... E02B 3/20
(52) U.S. Cl. ..... 405/220; 405/218
(58) Field of Search ..... 405/1, 219, 220, 405/221; 114/263, 230.15–230.19

(56) References Cited

U.S. PATENT DOCUMENTS 3,492,825 A * 2/1970 Pearson ..... 405/219
4,441,449 A * 4/1984 Biaggi ..... 114/263
5,588,782 A * 12/1996 Haring ..... 405/218
6,067,926 A * 5/2000 Robinson ..... 405/219
6,295,944 B1 * 10/2001 Lovett ..... 114/263
6,308,652 B1 * 10/2001 O'Neill ..... 114/263

* cited by examiner

*Primary Examiner*—Frederick L. Lagman

(57) ABSTRACT

A portable mooring dock for a boat for allowing a user to secure and safely anchor one's boat along a shoreline. The portable mooring dock for a boat includes boat connectors being fastenable to a boat; and also includes a boat mooring assembly being attached to the boat connectors, and including elongate support members and elongate cross member, and also including ground securement members for securing the elongate support members to a ground; and further includes a floatation assembly being connected to the boat mooring assembly to facilitate floatation of the boat mooring assembly.

13 Claims, 3 Drawing Sheets

PORTABLE MOORING DOCK FOR A BOAT

BACKGROUND OF THE INVENTION

1. Field of the Invention

The present invention relates to mooring docks for boats and more particularly pertains to a new portable mooring dock for a boat for allowing a user to secure and safely anchor one's boat along a shoreline.

2. Description of the Prior Art

The use of mooring docks for boats is known in the prior art. More specifically, mooring docks for boats heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 6,067,926; 4,913,078; 5,165,823; 4,142,477; 5,067,428; and Des. 212,654.

While these devices fulfill their respective, particular objectives and requirements, the aforementioned patents do not disclose a new portable mooring dock for a boat. The prior art includes portable boat docks having frames and other supports for securing the portable docks to the ground.

SUMMARY OF THE INVENTION

The general purpose of the present invention, which will be described subsequently in greater detail, is to provide a new portable mooring dock for a boat which has many of the advantages of the mooring docks for boats mentioned heretofore and many novel features that result in a new portable mooring dock for a boat which is not anticipated, rendered obvious, suggested, or even implied by any of the prior art mooring docks for boats, either alone or in any combination thereof. The present invention includes boat connectors being fastenable to a boat; and also includes a boat mooring assembly being attached to the boat connectors, and including elongate support members and elongate cross member, and also including ground securement members for securing the elongate support members to a ground; and further includes a floatation assembly being connected to the boat mooring assembly to facilitate floatation of the boat mooring assembly. None of the prior art includes the combination of the elements of the present invention.

There has thus been outlined, rather broadly, the more important features of the portable mooring dock for a boat in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new portable mooring dock for a boat which has many of the advantages of the mooring docks for boats mentioned heretofore and many novel features that result in a new portable mooring dock for a boat which is not anticipated, rendered obvious, suggested, or even implied by any of the prior art mooring docks for boats, either alone or in any combination thereof.

Still another object of the present invention is to provide a new portable mooring dock for a boat for allowing a user to secure and safely anchor one's boat along a shoreline.

Still yet another object of the present invention is to provide new portable mooring dock for a boat that is easy and convenient to set up and use.

Even still another object of the present invention is to provide a new portable mooring dock for a boat that prevents the possibility of sharp objects impacting the bottom of the boat along shorelines with the boat being safely anchored in the water off the shoreline.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
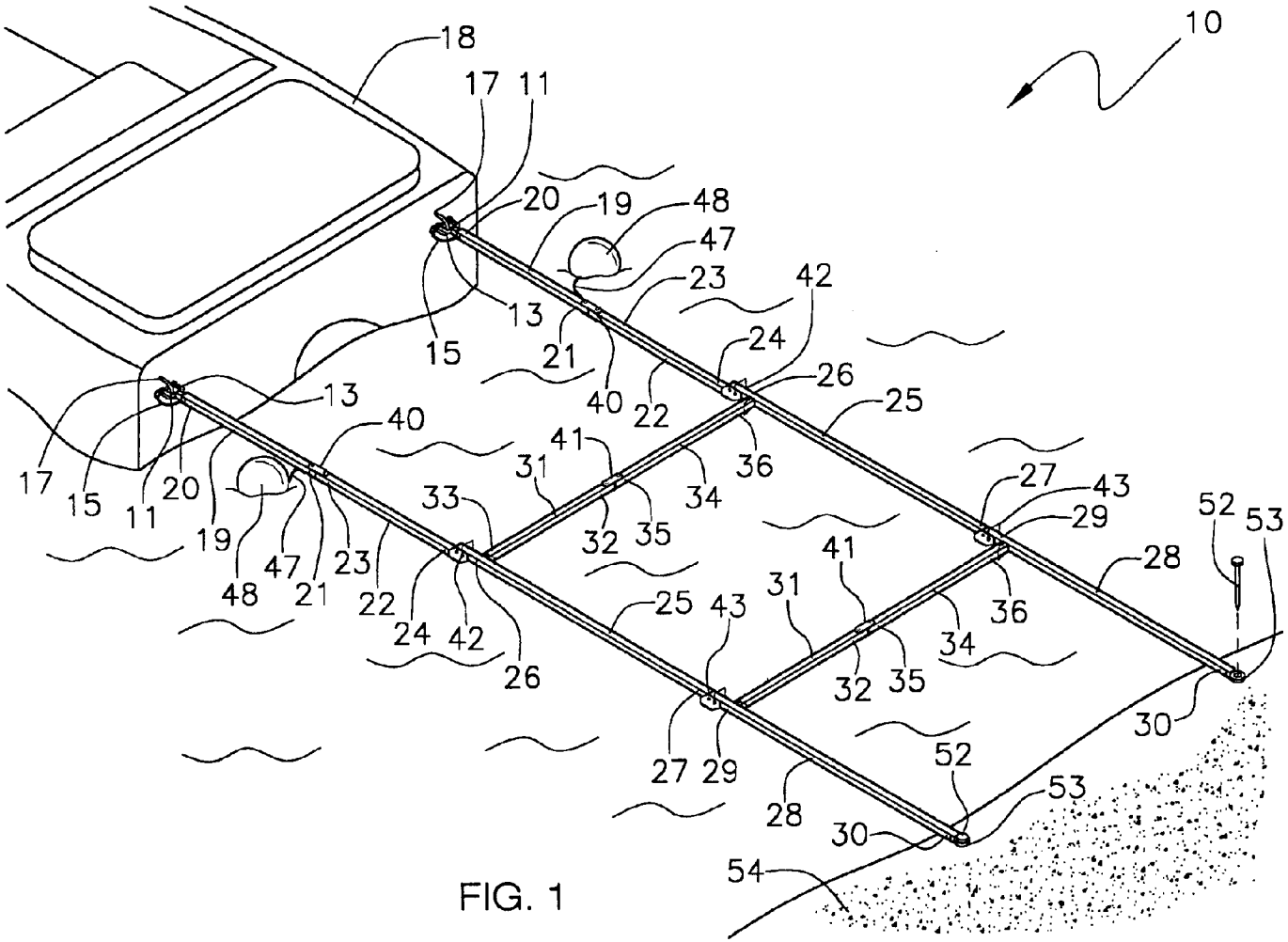
FIG. 1 is a perspective view of a new portable mooring dock for a boat according to the present invention.
Figure 2:
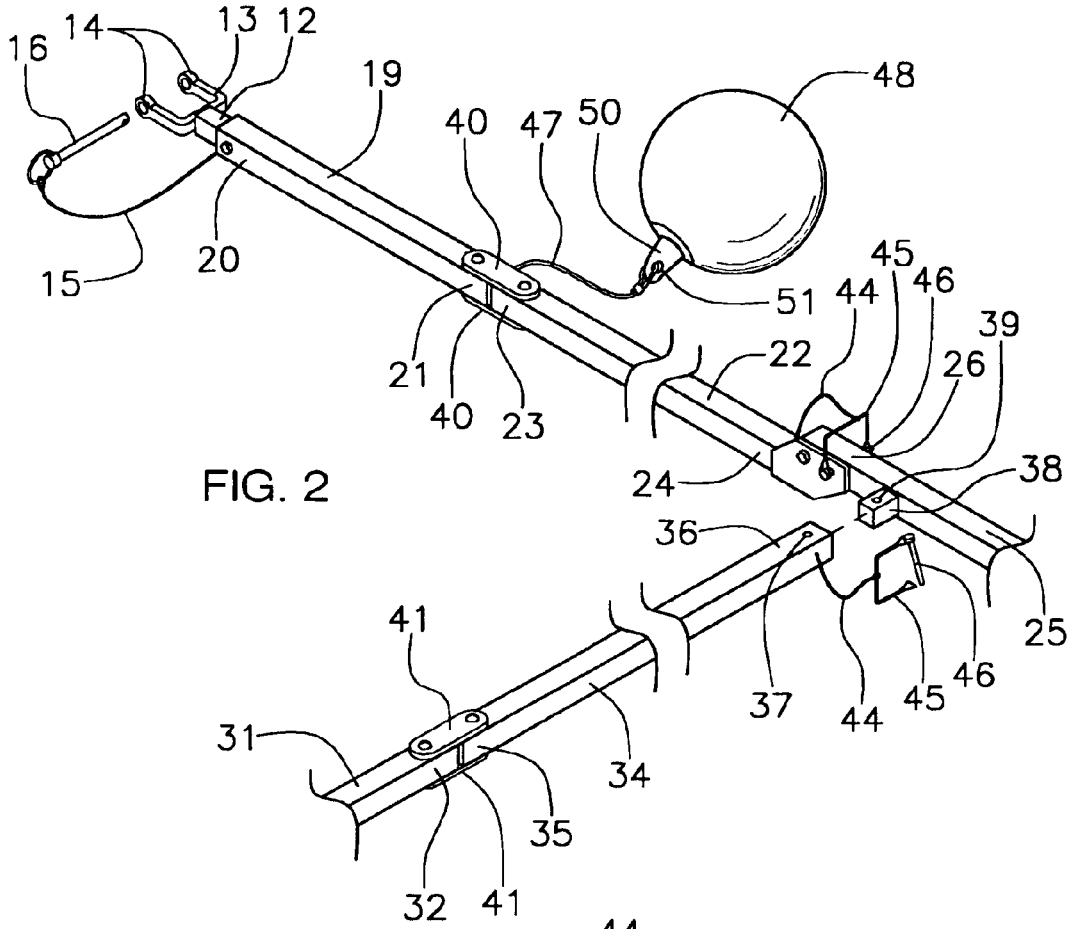
FIG. 2 is a detailed partial perspective view of the present invention.
Figure 3:
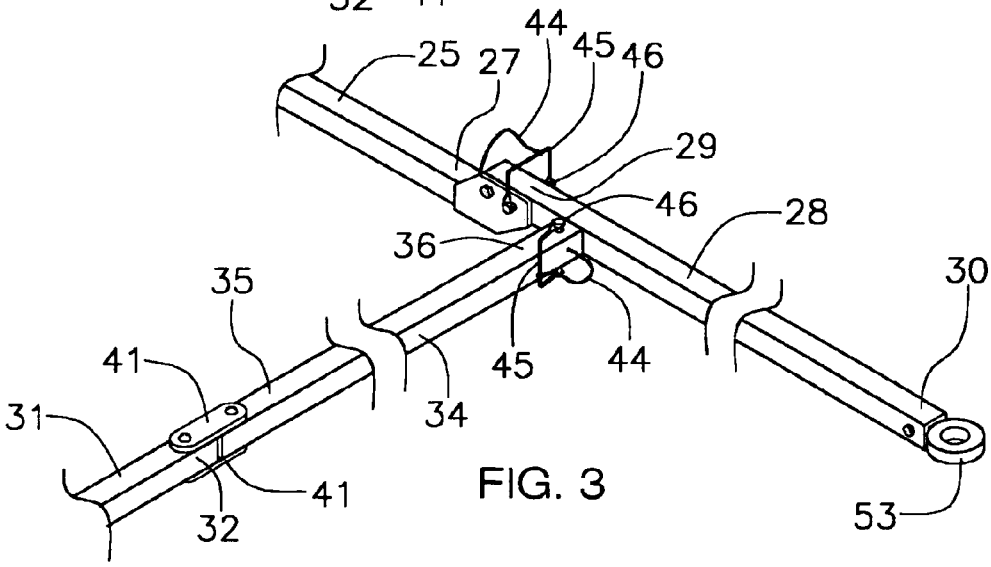
FIG. 3 is another detailed partial perspective view of the resent invention.
Figure 4:
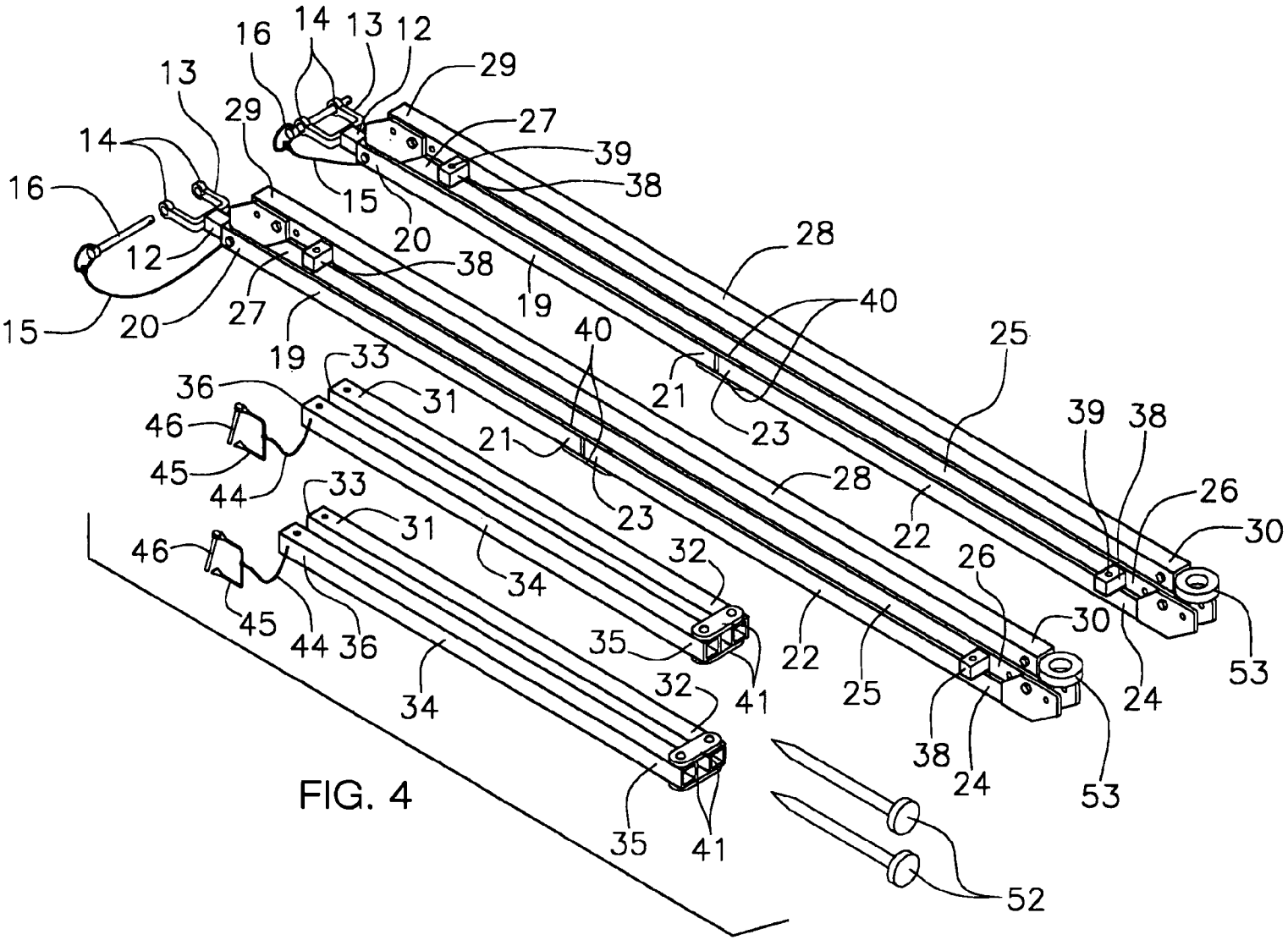
FIG. 4 is a perspective view of the present invention being aken apart and arranged for compact storing.

With reference now to the drawings, and in particular to FIGS. 1 through 4 thereof, a new portable mooring dock for a boat embodying the principles and concepts of the present invention and generally designated by the reference numeral 10 will be described.

As best illustrated in FIGS. 1 through 4, the portable mooring dock for a boat 10 generally comprises boat connectors 11 being removably fastenable to a boat 18. Each of the boat connectors 11 includes a shaft 12, and also includes a U-shaped bracket member 13 being securely and conventionally attached and welded to the shaft 12 and having grommet members 14 being conventionally attached and welded to ends of the U-shaped bracket member 13, and further includes a tether 15 and a fastener 16 being conventionally attached to the tether 15 and being removably received through the grommet members 14 to fasten the U-shaped bracket member 13 to a respective eyelet 17 being conventionally attached to the boat 18.

A boat mooring assembly is conventionally attached to the boat connectors 11, and includes elongate support members 19,22,25,28 and elongate cross members 31,34, and also includes ground securement members 52 for securing the elongate support members to a ground 54. The elongate support members 19,22,25,28 are conventionally connected to the boat connectors 11 and include two sets of the elongate support members with the elongate support members 19,22,25,28 of each of the two sets of the elongate support members being hingedly connected end to end. Each of the two sets of the elongate support members includes a first elongate tubular member 19 having first and second ends 20,21 with the shaft 12 of a respective boat connector 11 being securely and fastenably received in the first end 20 of the first elongate tubular member 19, and also includes a second elongate tubular member 22 being hingedly attached to the first elongate tubular member 19, and further includes a third elongate tubular member 25 being hingedly attached to the second elongate tubular member 22, and also includes a ground securement tubular member 28 being hingedly attached to the third elongate tubular member 25. The elongate cross members 31,34 includes two sets of the elongate cross members interconnecting the two sets of the elongate support members. Each of the two sets of the elongate cross members includes first and second tubular cross members 31,34 being hingedly attached to one another at first ends 32,35 thereof and being fastened at second ends 33,36 thereof to the elongate support members 19,22,25,28, and having holes 37 being disposed therethrough near the second ends 33,36 thereof. The boat mooring assembly further includes cross member connectors 38 being conventionally attached to and extending outwardly from the elongate support members 19,22,25,28 and having bores 39 extending therethrough. The cross member connectors 38 are fastenably and removably received in the second ends 33,36 of the first and second tubular cross members 31,34. The boat mooring assembly also includes grommets 53 being securely and conventionally attached to second ends 30 of the ground securement tubular members 28. The ground securement members 52 include stakes being removably received in the grommets 53 and being removably penetrated in the ground 54. The boat mooring assembly further includes first linkage members 40 being pivotally and conventionally attached to the second ends 21 of the first tubular members 19 and to first ends 23 of the second tubular members 22, and also includes second linkage members 41 being pivotally and conventionally attached to the first ends 32,35 of the first and second tubular cross members 31,34. The first and second tubular members 19,22 are foldable upon one another for compact storing thereof. The first and second tubular cross members 31,34 are removably disposed upon one another also for compact storing thereof. The boat mooring assembly also includes first brackets 42 being hingedly and conventionally attached to second ends 24 of the second elongate tubular members 22 and to first ends 26 of the third elongate tubular members 25, and also includes second brackets 43 being hingedly and conventionally attached to second ends 27 of the third elongate tubular members 25 and to first ends 29 of the ground securement tubular members 28. The first and second elongate tubular member 19,22 are foldable upon the third elongate tubular member 25, and the third elongate tubular member is foldable upon the ground securement tubular member 28 for easy storing thereof. The boat mooring assembly further includes flexible lines 44 being conventionally attached to the elongate cross members 31,34, and also includes flexible pin fastening members 45 being conventionally attached to ends of the flexible lines 44, and further includes pins 46 being conventionally attached to the flexible pin fastening members 45 and being removably received through holes 37 of the first and second tubular cross members 31,34 and of the first and second bracket members 42,43 and of the third elongate and ground securement tubular members 25,28 and through the bores 39 of the cross member connectors 38.

A floatation assembly is conventionally connected to the boat mooring assembly to facilitate floatation of the boat mooring assembly. The floatation assembly includes cords 47 being conventionally attached to the elongate support members 19,22,25,28, and also includes floatation members 48 being conventionally attached to the cords 47. Each of the floatation members 48 includes a balloon-shaped member 49 and also includes a tongue member 50 being conventionally attached to the balloon-shaped member 49 and having an eyelet 51 with a respective cord 47 being conventionally connected to the eyelet 51.

In use, the user would straighten out the elongate support members 19,22,25,28, and would interconnect the two sets of elongate support members with the elongate cross members 31,34. The user would then attach the boat connectors 11 to the eyelets 17 which are securely fastened to the boat 18 with the grommets 53 being secured to the ground 54 with the stakes 52. The boat 18 would be positioned just off shore without the bottom of the boat 18 impacting any of the ground 54 of the shoreline. When finished, the user would disconnect the boat connectors 11 from the eyelets 17 and would fold up the boat mooring assembly in a compact storable form.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the portable mooring dock for a boat. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A portable mooring dock for a boat comprising:

boat connectors being fastenable to a boat;

a boat mooring assembly being attached to said boat connectors, and including elongate support members and elongate cross member, and also including ground securement members for securing said elongate support members to a ground, each of said boat connectors including a shaft, and also including a U-shaped bracket member being attached to said shaft and having grommet members being attached to ends of said U-shaped bracket member, and further including a tether and a fastener being attached to said tether and being removably received through said grommet members to fasten said U-shaped bracket member to a respective eyelet being attached to the boat; and a floatation assembly being connected to said boat mooring assembly to facilitate floatation of said boat mooring assembly.

2. The portable mooring dock for a boat as described in claim 1, wherein said elongate support members are connected to said boat connector and include two sets of said elongate support members with said elongate support members of each of said two sets of said elongate support members being connected end to end.

3. The portable mooring dock for a boat as described in claim 2 wherein each of said two sets of said elongate support members includes a first elongate tubular member having first and second ends with said shaft of a respective said boat connector being securely received in said first end of said first elongate tubular member, and also includes a second elongate tubular member being hingedly attached to said first elongate tubular member, and further includes a third elongate tubular member being hingedly attached to said second elongate tubular member, and also includes a ground securement tubular member being hingedly attached to said third elongate tubular member.

4. The portable mooring dock for a boat as described in claim 3, wherein said elongate cross members includes two sets of said elongate cross members interconnecting said two sets of said elongate support members.

5. The portable mooring dock for a boat as described in claim 4, wherein each of said two sets of said elongate cross members includes first and second tubular cross members being hingedly attached to one another at first ends thereof and being fastened at second ends thereof to said elongate support members, and having holes being disposed therethrough near said second ends thereof.

6. The portable mooring dock for a boat as described in claim 5, wherein said boat mooring assembly further includes cross member connectors being attached to and extending outwardly from said elongate support members and having bores extending therethrough, said cross member connectors being fastenably and removably received in said second ends of said first and second tubular cross members.

7. The portable mooring dock for a boat as described in claim 6 wherein said boat mooring assembly also includes grommets being securely attached to second ends of said ground securement tubular members.

8. The portable mooring dock for a boat as described in claim 7, wherein said ground securement members include stakes being removably received in said grommets and being removably penetrated in the ground.

9. The portable mooring dock for a boat as described in claim 8, wherein said boat mooring assembly further includes first linkage members being pivotally attached to said second ends of said first elongate tubular members and to first ends of said second elongate tubular members, and also includes second linkage members being pivotally attached to said first ends of said first and second tubular cross members, said first and second elongate tubular members being foldable upon one another for compact storing thereof, said first and second tubular cross members being foldable upon one another also for compact storing thereof.

10. The portable mooring dock for a boat as described in claim 9, wherein said boat mooring assembly also includes first brackets being hingedly attached to second ends of said second elongate tubular members and to first ends of said third elongate tubular members, and also includes second brackets being hingedly attached to second ends of said third elongate tubular members and to first ends of said ground securement tubular members.

11. The portable mooring dock for a boat as described in claim 10, wherein said boat mooring assembly further includes flexible lines being attached to said elongate cross members, and also includes flexible pin fastening members being attached to ends of said flexible lines, and further includes pins being attached to said flexible pin fastening members and being removably received through holes of said first and second tubular cross members and through said bores of said cross member connectors and through holes in said first and second brackets and said third elongate and said ground securement tubular members, said first and second elongate tubular members being foldable upon said third elongate tubular member and said third elongate tubular member being foldable upon said ground securement tubular member.

12. The portable mooring dock for a boat as described in claim 11, wherein said floatation assembly includes cords being attached to said elongate support members, and also includes floatation members being attached to said cords.

13. The portable mooring dock for a boat as described in claim 12, wherein each of said floatation members includes a balloon-shaped member and also includes a tongue member being attached to said balloon-shaped member and having an eyelet with a respective said cord being connected to said eyelet.

* * * * *